United States Patent [19]

Pickett

[11] Patent Number: 4,529,174

[45] Date of Patent: Jul. 16, 1985

[54] POST AND PANEL WALL

[75] Inventor: William H. Pickett, Framingham, Mass.

[73] Assignee: The Reinforced Earth Company, Arlington, Va.

[21] Appl. No.: 477,314

[22] Filed: Mar. 21, 1983

[51] Int. Cl.[3] ..... E04H 17/16

[52] U.S. Cl. ..... 256/27; 256/25; 52/259

[58] Field of Search ..... 256/24, 27, 28, 29, 256/19, 25; 52/259

[56] References Cited

U.S. PATENT DOCUMENTS

| | | | |
|---|---|---|---|
| 1,429,084 | 9/1922 | Loeffler | 256/24 |
| 3,530,628 | 9/1970 | Ferris et al. | 52/248 |
| 3,732,653 | 5/1973 | Pickett | 256/26 X |
| 3,902,702 | 9/1975 | Kinnaman | 256/19 |
| 4,111,401 | 9/1978 | Pickett | 52/71 X |

FOREIGN PATENT DOCUMENTS

| | | | |
|---|---|---|---|
| 272985 | 4/1964 | Australia | 256/24 |

*Primary Examiner*—Andrew V. Kundrat

*Attorney, Agent, or Firm*—Burns, Doane, Swecker & Mathis

[57] ABSTRACT

A post and panel barrier system employs posts which are contoured to provide a constant maximum bending stress for anticipated wind pressure distributions. Posts and associated panel assemblies permit adjacent panels to meet at angles ranging from 0° to 360°. Panel assemblies used in the barrier system may be folded so that thermal movement and spacing tolerances are automatically compensated. Posts and panels may be decoupled to allow relative vertical displacements.

19 Claims, 14 Drawing Figures

Fig. 2
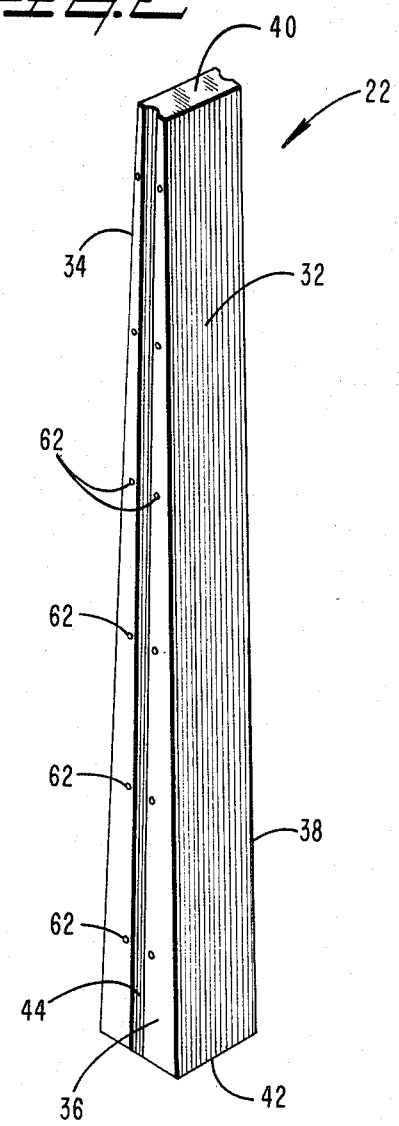
Fig. 3
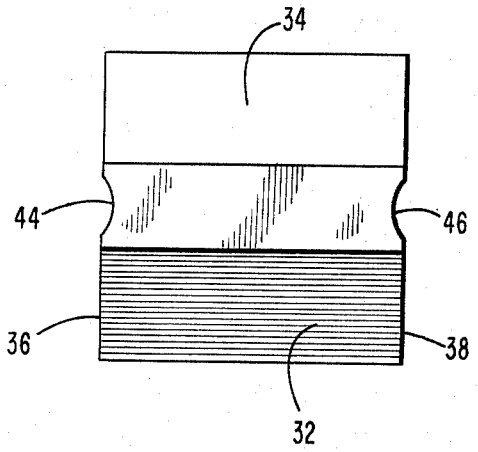
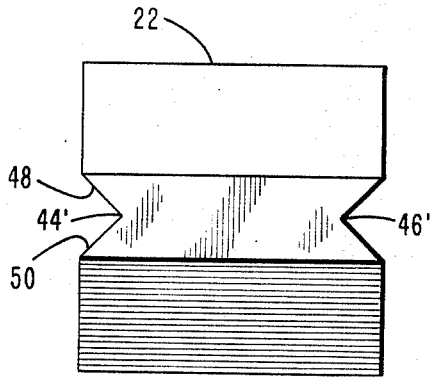
Fig. 4
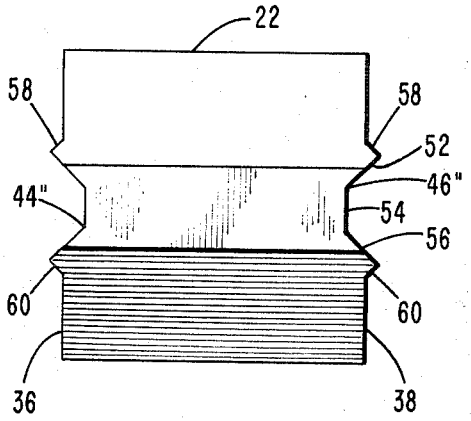
Fig. 5
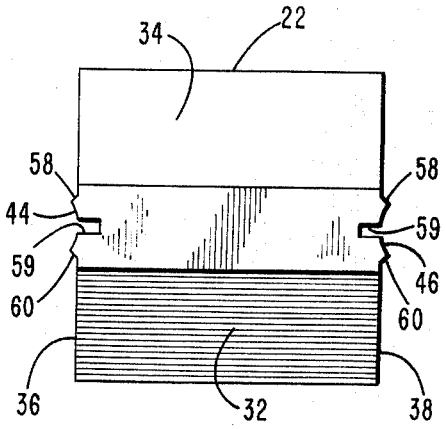
Fig. 6

POST AND PANEL WALL

The present invention generally relates to post and panel type walls. More particularly, the present invention concerns an improved post for use in connection with panel walls of the free-standing variety.

In recent years, many civil engineering projects have required the placement of a free-standing barriers along project boundaries to control environmental radiated energy problems and to create opaque walls. Typical radiated energy problems include noise, electromagnetic energy, and nuclear radiation. Each of these problems is potentially a two way problem. More particularly, in some applications it is desired to keep the energy out of an area while in other applications it is desired to keep the energy in a particular area.

As used in this patent, free-standing means a nonloadbearing wall structure which extends upwardly above an underlying ground surface so that both sides are exposed to wind loading, air borne chemicals, scouring, and other environmental weather including ultraviolet radiation and fungi. Commonly, undulating barriers use a zigzag or other offset arrangement of panels that is self-supporting. One offset type barrier system is illustrated and described in U.S. Pat. No. 4,111,401 which was issued Sept. 5, 1978 to William H. Pickett. An example of a structure having the zigzag type is illustrated in U.S. Pat. No. 3,732,653 which issued May 15, 1973 to William H. Pickett.

In many municipal areas, the practical availability or cost of purchasing rights-of-way for civil engineering projects has created a need for an environmental barrier system which extends in a more generally straight line than the zig zag or offset type systems. Such a straighter line arrangement for an environmental barrier thus minimizes the additional right-of-way that must be acquired for the project when compared to a sound barrier systems which use offsets, zigzags and the like. Undulating barrier systems prove less costly than straight line systems when adequate and inexpensive right-of-way space is available.

When free-standing undulating barrier systems are converted to straight line systems, post and panel arrangements have generally been found to be preferable to other systems such as embedding panels. In a post and panel arrangement, a plurality of posts are spaced at predetermined distances from one another along the desired line for the barrier. When the posts are set in position, panels of metal, concrete, wood, plastic or the like are supported between adjacent posts to create the barrier structure which will attenuate radiated energy or block sight.

Known post and panel systems experience a variety of problems and use limitations. One problem associated with these known post and panel systems is the need to very precisely position adjacent posts if prefabricated panels are to be positioned therebetween. The positioning problem include not only the post-to-post spacing but also the plumbness of the post both to the wall face and the panel edge. Once the panel dimensions are selected and the panels are fabricated, then the spacing between adjacent posts must correspond to the panel length for the full exposed length of the post. If this positioning is not maintained, then the panels will not be accepted between posts (spacing too close) or the panels cannot be attached to the posts (spacing too great). In a species of the latter case, a poor acoustic joint may result requiring specialized treatment. This spacing problem can be exacerbated by the comparatively large fabrication tolerances which in the case of a precast concrete elements may be in the neighborhood of plus or minus one quarter inch.

Another problem with the post and panel barrier arrangements is the exposure of the wall to design wind pressure. Since environmental walls may be quite high (for example, on the order of 35 ft.), a substantial surface area is presented by the panels which can be acted upon by wind pressure. In some localities wind velocities as high as 120 mph can be expected corresponding to wind pressure loadings of about 46 pounds per square foot. In such localities, posts supporting the panels must be designed with full cognizance of the expected, and aberrational once-in-50-year, design wind pressure levels that may be acting upon the wall during its life. Additionally, the design physics of such wind pressures are increased by gust, drag and safety factors.

Customarily, posts for such post and panel walls, as well as for fencing, have been designed by determining the maximum force load conditions that will be exerted on the posts. Typically, the post comprises a member cantilevered out of the earth or some other structure which partially supports each of the adjacent panels. In such an arrangement, the maximum force load condition ordinarily occurs near the grade level, that is, the area where the post enters the underlying ground or other support structure.

In the past, posts have ordinarily been made from tree trunks, rolled and extruded metal shapes, cast concrete and the like. Economy of fabrication has dictated heretofore that the post have a uniform cross section from one end to the other, the cross-sectional dimensions being selected to accomodate the maximum force load condition. Thus, little or no effort was made in the past to optimize the post design and structure for the loading conditions to which the post would be exposed.

More recently, some posts have been fabricated from precast concrete. In keeping with tradition, these concrete posts are generally provided with a uniform cross-section. However, any post whether of wood, metal or concrete, having a uniform cross-sectional shape is not significantly stressed at all cross sections and, therefore, is not efficiently used. Consequently, substantial amounts of structural material are wasted; adding considerably to the material expense for the post and shipping costs for delivering the post to a job site.

The manufacturing and placement tolerances discussed above in connection with post spacing also create problem for precast concrete posts. Since the tolerances in both the post and panel fabrication can accumulate along with the post spacing and verticality tolerances, the accumulation of tolerances can lead to a loose joint between panels and posts. With a loose joint, vibration can occur, and sound, light and radiation energy can pass through the barrier structure as well.

Another problem associated with a straight line post and panel system concerns thermally induced linear expansion and contraction after erection. Such thermal variations in the wall can lead to loose joints during contraction as discussed above, structural damage of the posts and panels due to compressive stress developed during expansion, and difficulty in construction when large thermal variations occur.

Accordingly, it is apparent that the need continues to exist for a post and panel barrier system which overcomes problems of the type discussed above.

SUMMARY OF THE INVENTION

The present invention overcomes problems of the type discussed above by providing a precast concrete post, having a cross section which varies from a first location adjacent the top to a second location adjacent to the bottom or, at least, spaced from the first location. The variation in post cross-sectional size is determined such that an essentially constant maximum bending stress is provided anywhere in the post between the two locations under the design conditions. In this manner, material usage in the post is optimized and material waste is minimized.

In addition, in order to relax the acceptable tolerances for post-to-post spacing, a resilient joint packing may be provided. This resilient packing expands or contracts as necessary to accomodate tolerance accumulations resulting from build up of casting tolerances as well as post-to-post spacing. Moreover, thermal expansion and contraction can be accomodated with the joint packing.

The problems of spacing tolerances and linear thermal expansion may also be accomodated in the post and panel barrier construction of this invention by use of a folded plate panel assembly between adjacent posts. This folded plate panel assembly has an articulatable joint between adjacent sections of the panel assembly. Articulation of the joint occurs if, as, and when thermal expansion so requires. In addition, the articulatable joint is useful to further relax the tolerances on post-to-post spacing. The resilient joint packing can be used in combination with, and as an alternate to, the folded plate panel assembly.

To provide flexibility in the post and panel system to accommodate changes and ground surface elevation, the post may be provided with a plurality of lateral channels to receive corresponding connecting devices. The connecting devices attach panel assemblies to the associated posts. By providing these channels at conveniently spaced apart locations along the length of the post, panel elevation can be adjusted to accommodate ground contour changes in a step-up fashion.

Furthermore the post panel and connector parts of this invention permit the wall to follow horizontal and vertical curves. Moreover, corners in the wall from essentially 0° to essentially 360° may be negotiated by the wall.

BRIEF DESCRIPTION OF THE DRAWINGS

Many objects and advantages of the present invention will be apparent to those skilled in the art when this specification is read in conjunction with the attached drawings wherein like reference numerals have been applied the like elements and wherein:

FIG. 2 is a perspective view of a post constructed in accordance with the present invention;

FIG. 3 is an enlarged plan view of the post of FIG. 2;

FIGS. 4, 5 and 6 are plan views of alternate cross-sectional embodiment of the post illustrated in FIG. 2;

DESCRIPTION OF THE PREFERRED EMBODIMENTS

Figure 1:
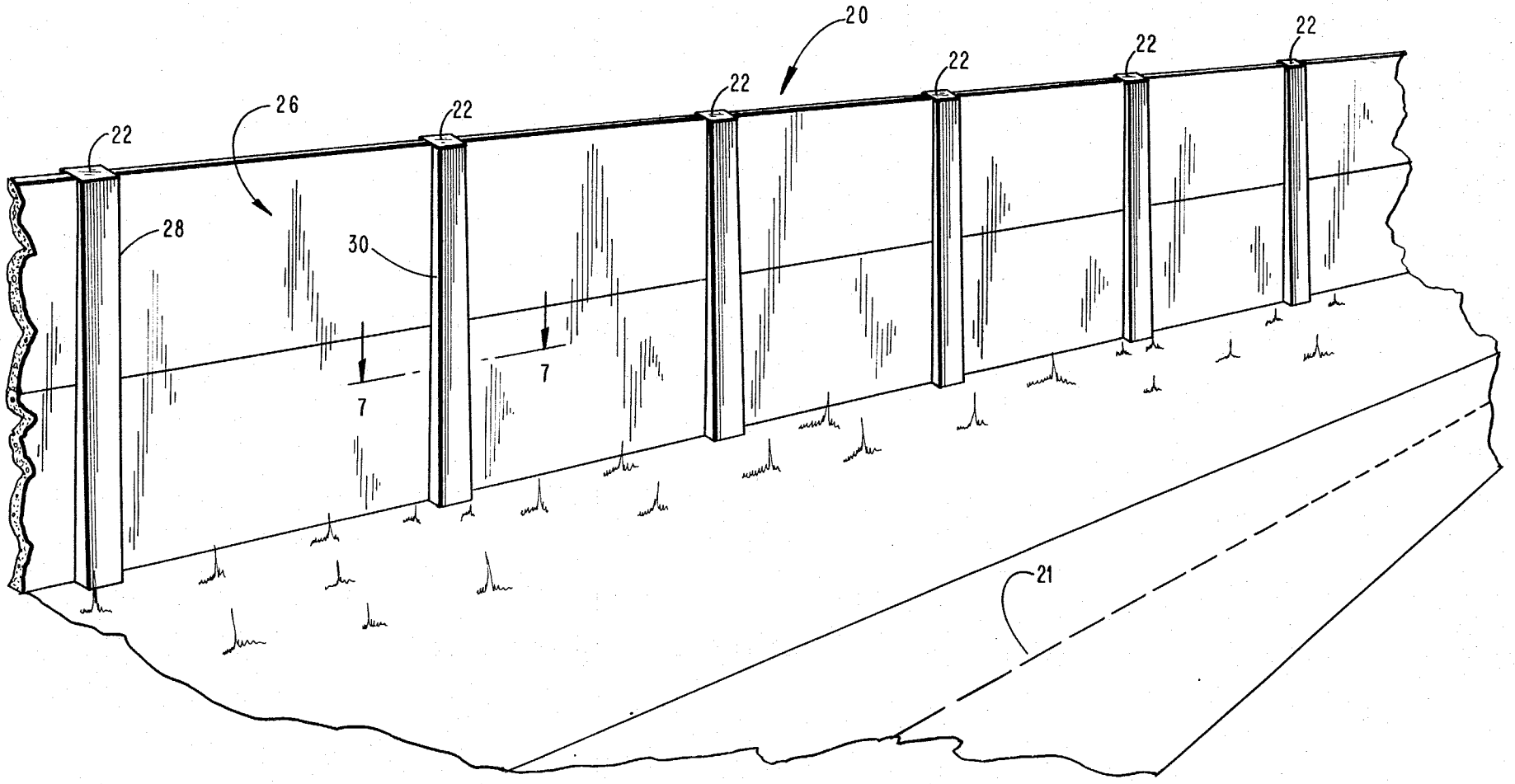
FIG. 1 is a perspective view of a post and panel wall constructed in accordance with one embodiment of the barrier system of the present invention.

Turning now to FIG. 1, a privacy wall 20 for controlling sight, sound, fire, trespass, drift, erosion or radiated energy is positioned along a side boundary of a civil engineering structure 21 such as a highway. The wall 20 has post and panel construction. The wall 20 includes a plurality of precast concrete posts 22 each of which is preferably spaced from adjacent posts by a uniform predetermined distance along a generally straight line. While uniform post spacing is preferable, in some application the spacing may be variable. Typical distances between posts are, for example, 20, 25 and 30 ft.

Each post 22 extends vertically out of the underlying ground 24 to a height which is generally coextensive with the barrier height. Typical heights for the barrier range from 5 to 30 feet. If the barrier is used for security purposes, additional security devices including fencing may be mounted to the tops of the posts.

Spanning the distance between adjacent posts 22 is a panel means 26 for establishing the privacy barrier. Each panel means 26 has a pair of generally parallel side edges 28, 30 each edge being attached to a corresponding post adjacent to that side edge. Where the height of the wall 20 becomes particularly large, for example, in excess of 10 ft, it will ordinarily be desirable to use a plurality of vertically stacked panel elements to give the panel means 26 the requisite height. The height of these component panel elements lies in the range of 8 to 12 feet and is selected such that individual panel elements can be readily transported by commonly available vehicles in compliance with highway regulations.

Each post 22 (see FIG. 2) includes a front surface 32, a rear surface 34, and a pair of generally parallel side surfaces 36, 38. The distance between the front and rear surfaces 32, 34 defines a post thickness; similarly, the distance between side surfaces 36, 38 defines a post width.

Generally speaking, the post 22 has a cross-sectional area which varies from a first location near the free end to a second location remote from the free end of the post. In a typical design, the first location will be located at the top of the post 40. The second location 42 will be spaced from the top 40 of the post and will typically be located at the bottom of the exposed portion of the post 22. More particularly, the second location 42 would ordinarily be positioned at approximately the grade level where the post 22 projects vertically upwardly out of the underlying ground.

To support the post 22 in its vertically upstanding position, any one of a multitude of suitable conventional foundations may be used. For example, caissons may be provided from which the post 22 projects upwardly or, the post 22 may include an elongated portion projecting downwardly beyond the second location 42 so that the post can be driven into the underlying soil or supported by a cast-in-place footing.

As noted, the cross-sectional area of the post 22 (FIG. 2) varies between the first location 40 and the second location 42. In most cases, the cross-sectional area will be symmetrically distributed in each of two planes. One plane of symmetry is vertical and lies in the plane between two adjacent posts. The second plane of symmetry is also vertical but is perpendicular to the first plane of symmetry, i.e., normal to the plane between adjacent posts. However, there may be applications where symmetry in one or both such planes is not needed or not desired.

The cross-sectional area variation between the first and second locations is selected to provide optimal material utilization in the post 22 and thereby minimize the weight of the post 22, minimize the material cost for the post, and provide standardization of design. The cross-sectional area variation from the first location 40 to the second location 42 is determined such that an essentially constant maximum bending stress exists in the post 22 between the first location 40 and the second location 42. In making this bending stress determination, the presence of steel reinforcements in the concrete material must be considered. For simplicity, the reinforcements are not illustrated in the various illustrations here.

In a preferred embodiment of the post 22, the post width is essentially constant from the first location 40 to the second location 42 (the second plane of symmetry being parallel to the side surfaces 36, 38); and, the depth of the post between the front surface 32 and the back surface 34 provides the cross-sectional area variation between the two spaced locations 40, 42 (the first plane of symmetry being essentially equidistant from the front and back surfaces 32, 34). With this arrangement of surfaces on the post 22, the thickness variation between the two locations 40, 42 can be most easily designed to give the constant maximum bending stress.

The above reference to an essentially constant maximum bending stress allows economy in form construction for casting the concrete post 22. More specifically, it may be more convenient in the molding operation to develop the contour of the front surface curve 32 and the rear surface curve 34 from chord-like straight line approximations to the design curve. These straight line approximations to the curves will allow some deviation from the constant maximum bending stress that might otherwise be attainable with a post designed strictly in accordance with the present invention.

In establishing the post depth variation between the first location 40 and the second location 42 the forces acting upon the post 22 must be considered. These forces must include, the maximum design wind pressure to which the wall of FIG. 1 is exposed multiplied by an appropriate safety factor, gust factor and drag factor. It will be noted that the wind pressure acting on a structure is non-uniform and varies approximately as elevation (i.e. distance of any point above the ground surface) raised to the 1/7th power, i.e., $p\ h^{1/7}$. Wind pressure, p, is assumed to act on the surface area of the panel means 26 extending between adjacent posts as well as the posts 22 themselves. And, the wind pressure distribution (i.e., vertical intensity) is determined by considering the topography around the wall site. That portion wind pressure acting on the panel means is applied to the post as a distributed force extending between the first and second locations 40, 42.

Weight of the panel means themselves, in addition to the weight of the posts, resists the toppling effect of wind pressure on the posts; thus wall panels must also be included in the analysis. These various weights contribute a greater stability to the wall against toppling as one progresses from the top of the post 40 to the bottom of the post 42. This enhanced stability is in part due to the increasing moment arm about which toppling must occur, which moment arm corresponds to about one-half the depth of the post 22 at any given elevation.

In some instances where right-of-way width permits, the panel means extending between adjacent posts is folded about a hinge line intermediate the adjacent posts (see, for example, FIGS. 9, 10 and 12–14). In such instances, the effect of the folded panel means can provide further substantial resistance to overturning by wind pressure loading because the assembly has a wider base moment arm on which its stabilizing weight may act. Accordingly, when the post thickness variation is being developed using the folded plate, the effective wall stability due to a hinged or folded panel means must also be included to optimize post configuration.

Each side surface 36, 38 (FIG. 2) of the post 22 is provided with a corresponding groove 44, 46 (FIG. 3). Each groove 44, 46 extends from the top of the post 22 to the bottom of the post and cooperates with a conformingly shaped edge from the panel means positioned between adjacent posts. In the preferred embodiment, the grooves 44, 46 are arcuate in cross-sectional shape and comprise a circular arc of approximately 90°. The radius of the arc is selected to conform to the radius provided on the corresponding side edges 28, 30 (FIG. 1) of the panel means 26 positioned between adjacent posts 22.

While the grooves 44, 46 (FIG. 3) are preferably arcuate, it is also within the scope of the present invention to form those grooves from other shapes. For example (FIG. 4), the grooves 44', 46' are fashioned from two planar segments which appear in cross section as straight line elements 48, 50. These straight line elements can approximate an arcuate shape if desired. Here again, casting considerations for the post 22 may suggest the desirability of utilizing straight line elements in forming the grooves 44', 46'.

Figure 11:
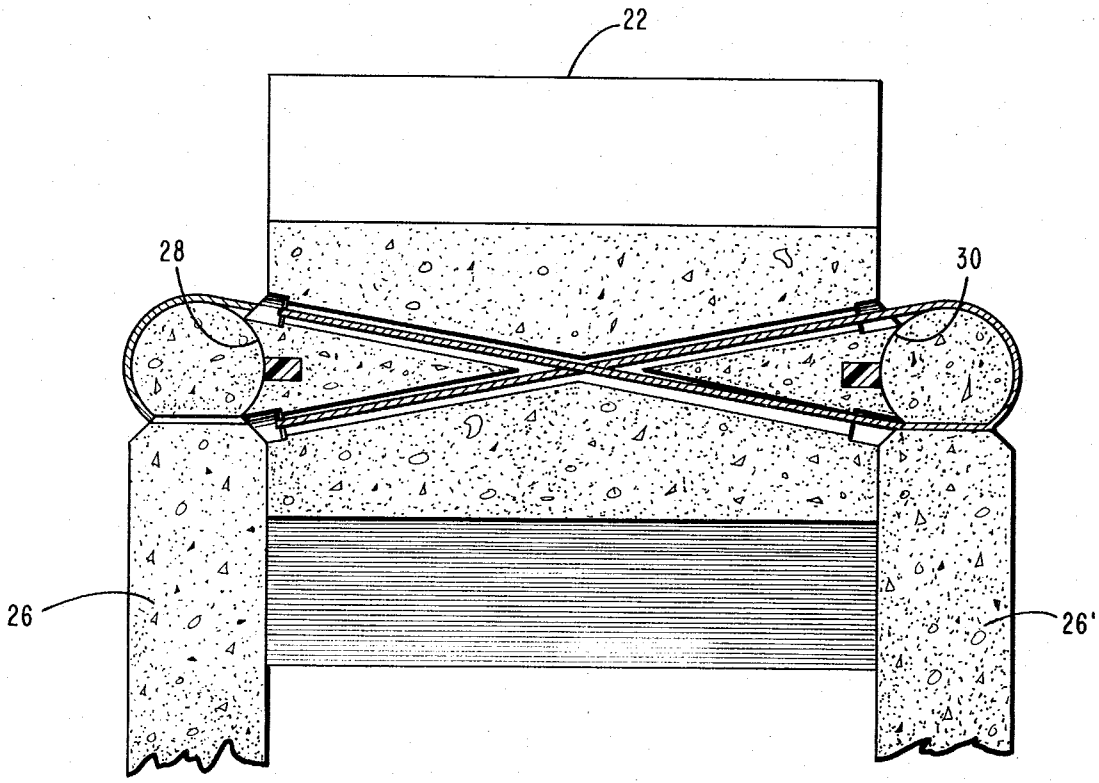
FIG. 11 is an enlarged cross-sectional view, similar to FIG. 7, illustrating a 0° corner using posts and panels of the present invention.
Figure 12:
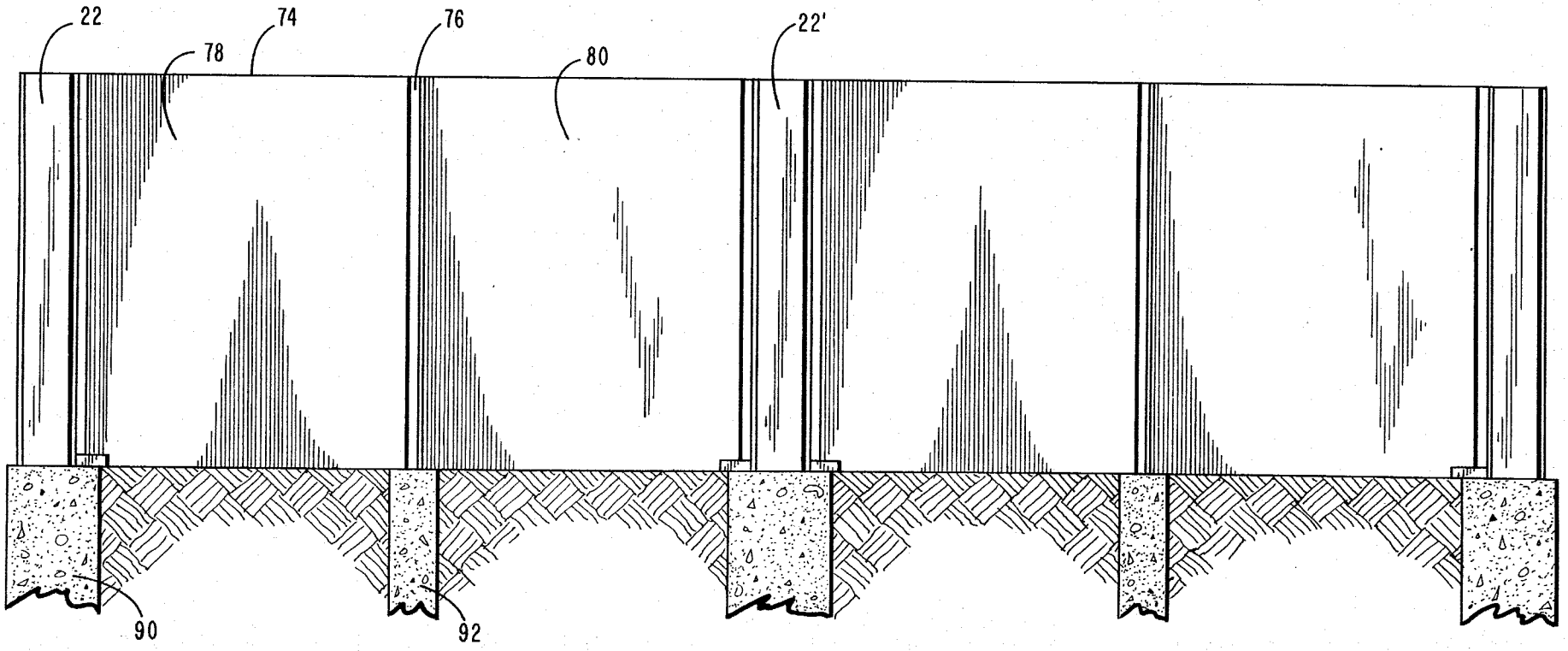
FIG. 12 is a front elevational view showing a first embodiment of vertical support for wall panels.
Figure 13:
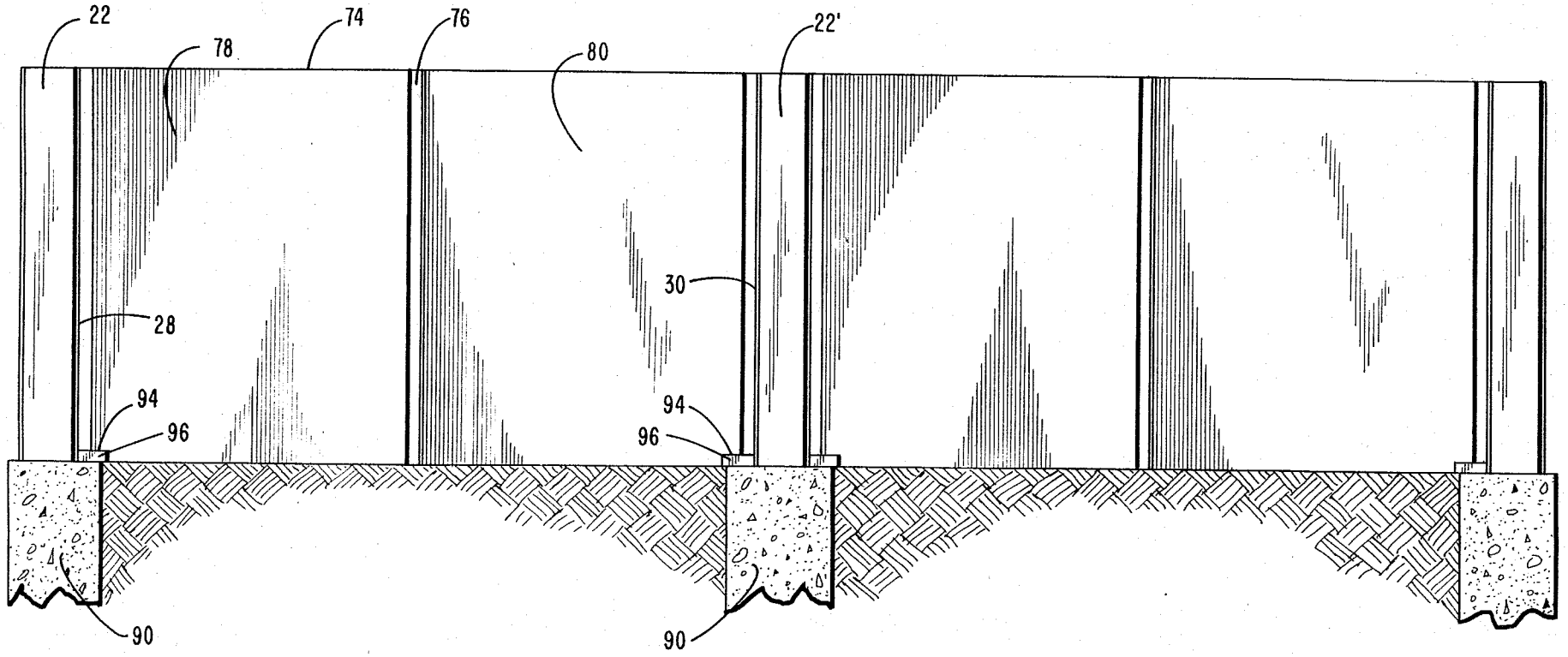
FIG. 13 is a front elevational view showing a second embodiment of vertical support for wall panels.

In FIG. 5, the grooves 44'', 46'' are again made up from a plurality of planar segments which appear as straight line elements 52, 54, 56 in cross section. A multiplicity of line elements give a better approximation of the desired arcuate shape. As another feature, each of the grooves 44'', 46'' is recessed beneath laterally projecting shoulders 58, 60 that are integrally cast with the corresponding side surfaces 36, 38 of the post 22. The shoulder 58, 60 can be used in any of the embodiments. As shown in FIG. 5, the bottom of the grooves 44'', 46'' intrude beyond the plane of the corresponding side surface 36, 38 into the central portion of the post 22. As the depth of the groove 44'', 46'' (measured from the bottom of the groove 44'', 46'' to the plane of the corresponding side surface 36, 38) decreases and the bottom of the groove approaches the plane of the corresponding post-side surface, there is an increase in the range of angles at which the post 22 and panel means can be connected. For example, the post and panel system can be designed to accommodate angles essentially from 0° to 360°, (FIG. 11).

A post 22 suitable for applications where wall panels are at angles from 0° to 360° to one another is illustrated in FIG. 6. Here, each groove 44, 46 is arcuate in cross section and subtends an angle of about 90° about its corresponding center. The bottom of each groove 44, 46 is essentially tangential to the plane of the corresponding side surface 36, 38. At each side of each groove 44, 46, the shoulders 58, 60 restrain a panel means from slipping along the plane of the side surfaces 36, 38. To permit sealing between the panel means and the corresponding groove, each groove 44, 46 may be provided with a slot 59 which extends radially into the post body from the bottom of the groove. The slot 59 has a depth away from the groove sufficient to retain a resilient packing.

To facilitate connecting the wall panel means 26 to the post 22 (see FIG. 2), each post is provided with a plurality of channels 62. Each channel 62 extends between the side surfaces 36, 38 (FIG. 7), is aligned to be tangential to the bullnose 70, 70' of each panel means 26, 26' adjacent to the post 22 and has a counterbore at each place where it meets a side of the post 22. In addition, each channel 62 has a cross-sectional size which is selected to permit a flexible tensile connector to pass therethrough. These channels 62 may be regularly spaced in pairs along the entire length of the post 22.

Figure 7:
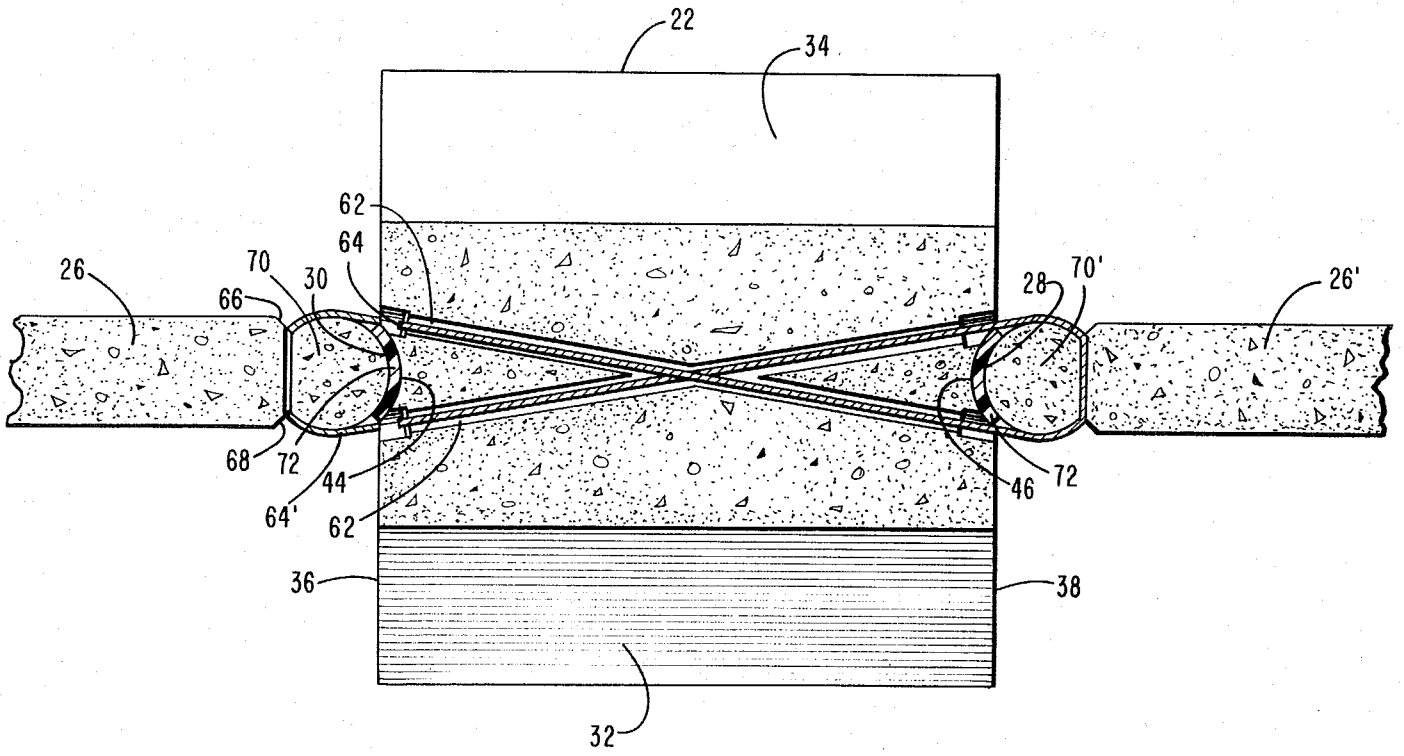
FIG. 7 is an enlarged cross-sectional view taken along the line 7—7 of FIG. 1.

Ordinarily, the connecting means 64 will attach one panel means 26' to one side of the post 22. As shown in FIG. 7, the connector means 64 attaches the panel means 26' to the post 22 whereas the connector means 64' attaches the panel means 26 to the post 22. As seen from FIG. 7, the two connector means 64, 64' do not lie in the same horizontal plane. Spaced above or below the connecting means 64 is a second connecting means 64' which attaches the second panel means 26 to the opposite side of the post 22. Each panel means 26, 26' is attached to the post 22 by at least two vertically spaced connectors 64. If desired, the connecting means could simultaneously attach both panel means 26, 26' to the post 22. Moreover, if desired the channels 62 could have other configurations.

While at least two pairs channels 62 will be necessary to attach most panel means 26 to the post 22, a larger number of channel pairs 62 are typically provided. These additional channel pairs 62 provide a means for adjusting the vertical height of panel means 26 relative to the post 22 while using the same type of connecting assembly. Ordinarily, the channels 62 will be provided at vertically spaced increments which correspond to the minimum desired height increment between panel means in adjacent portions of the wall.

The channel 62 (see FIG. 7) is sized to permit workmen to manipulate a connecting means 64 through the post 22 in order to attach adjacent wall panel means 26, 26' to the post. In its preferred form, the connecting means 64 comprises a flexible tensile element which is attached at each end in a corresponding counterbore of the channel 62. The connecting means 64 biases the respective panel means 26, 26' toward each other and into engagement with the corresponding grooves 44, 46 provided in the side surfaces 36, 38 of the post 22. A suitable, flexible tensile element is illustrated, for example, in U.S. Pat. No. 4,111,401, the contents of which are incorporated herein by this reference thereto.

As will be seen from FIG. 7, each side edge 30, 28 of the wall panel means 26, 26' has a shape which conforms to the cross-sectional shape of the corresponding groove 44, 46 provided in the post 22. In this embodiment, the side edges 28, 30 of the panel means are contoured so as to be arcuate in cross section. Moreover, the cross-sectional arc of the panel means preferably extends for an angle of approximately 270° symmetrically disposed about a central plane. A pair of shoulders 66, 68 extend backwardly from the rounded or bullnose side edges 30, 28 to the front and rear planar surfaces of the wall panel means 26. The radius of the bullnose end 70 is preferably selected to be equal to at least half the thickness of the wall panel 26. That bullnose 70 must, however, be positioned in the groove so that there is overlap of panel material and post material. Thus, material of the panel means 26 would shear material of the post 22 and adequate retention is attained. That is, the packing material 72 should not be relied upon to restrain movement of the panel means along the faces 36, 38 unless the packing material has a shear strength equivalent to the post material.

Figure 8:
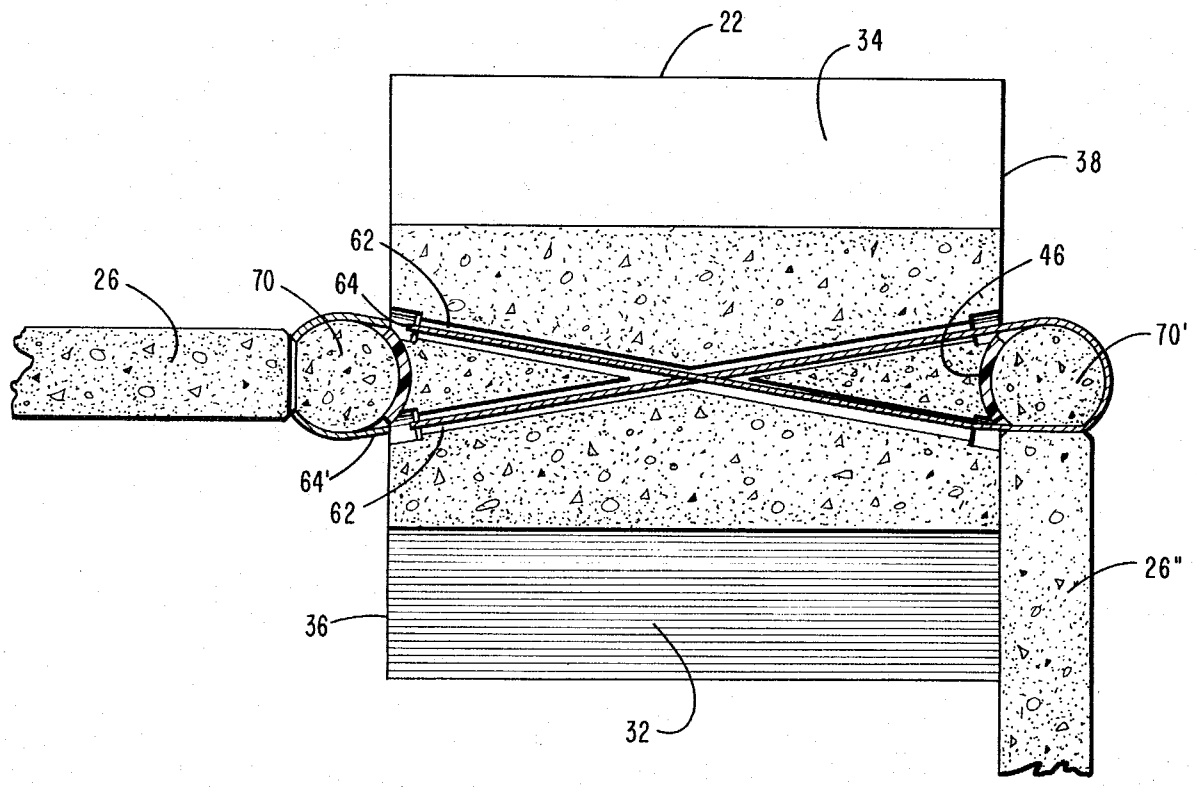
FIG. 8 is a cross-sectional view, similar to FIG. 7, illustrating a 90° corner with posts and panels of the present invention.

The foregoing relationship between the radius of the bullnose 70 and the thickness of the panel 26 permits the wall panel 26'' (FIG. 8) to be moved relative to the post 22 so that the wall panel 26'' creates an essentially right angle relative to the plane of the wall panel 26 approaching the post 22 from the left. Clearly, the wall panel 26'' could assume any angle less than 90° with respect to the lateral plane of the post 22. If both panels are attached to the post 22 so as to define the maximum external angle, an angle of essentially 360° can be obtained (FIG. 11).

In typical precast concrete construction, tolerances of $\pm\frac{1}{4}$ inch or more are common, depending on experience of fabricators and cost of forms. Accumulations of such tolerances require that positioning and placement of posts 22 be very precise in order to accommodate the precast panel means 26 therebetween. Precise tolerances on the lateral spacing between posts can be very difficult to maintain at construction sites. To overcome the problems with precise tolerances, a joint packing material 72 (FIG. 7) may be provided between the bullnose 70 and the adjacent groove 44, as well as between the bullnose 70' and the adjacent groove 46. The packing material 72 extends from the top of the post 22 to the bottom of the post along the entire length of the groove 44, 46. The width of the packing material may be selected to be approximately coextensive with the formed post surfaces defining each groove 44, 46.

The thickness of the packing material 72 is selected such that it will be compressed partially when the minimum size bullnose 70 cooperates with the deepest groove 44, 46 and the shortest panel means 26 is positioned between two posts with the maximum distance therebetween. In addition, the packing material 72 will accommodate compression that results when the largest bullnose 70 is received by the shallowest groove 44 when the longest panel means 26 is positioned between two posts with the minimum distance therebetween. In this fashion, the maximum bullnose 70 can also be accommodated by the shallowest groove 44 with the packing material 72 not being compressed to such a degree that it will prohibit placement of the panels 26 between adjacent posts. If desired, the packing material 72 may be formed as a flat sheet or as a preformed arcuate member having a shape corresponding approximately to the shape of the grooves 44, 46. It is not necessary, however, that the packing material 72 be coextensive with the arcuate dimension of the groove since, for acoustic purposes, only a simple blockage is needed.

The cross-sectional shape of the bullnose 70 conforms to the cross-sectional shape of the groove 44, 46. This correspondence may be essentially exact as in the case when no packing material 72 is employed, i.e., the bullnose radius and the groove radius may be equal. Alternatively, the bullnose 70 may have a radius which is less than the radius of the groove 44 by an amount corresponding to about one-half the compressible thickness of the gasket material 72. In this fashion, the packing material 72 will be subjected to essentially radial compression when the attachment means 64 connects adjacent panels 26, 26'' with the post 22.

With a packing material 72 having a thickness as described, the packing material 72 will accommodate those tolerances in the post positioning.

Figure 9:
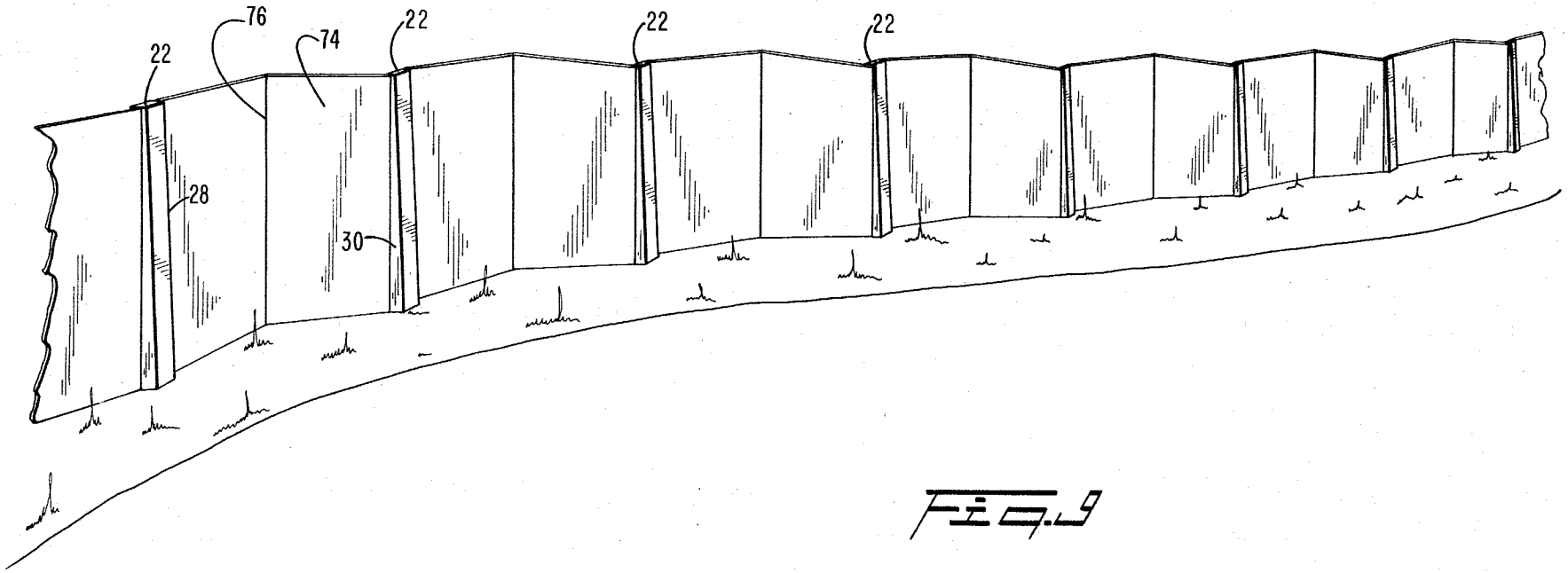
FIG. 9 is a perspective view of a second embodiment of the barrier system of the present invention.

While the panel means 26 of FIG. 1 are flat and generally planar, many applications of the post and panel barrier exist which experience considerable variations in ambient temperature and where spacing tolerances cannot be easily maintained. Variations in ambient temperature may lead to creation of significant compressive stresses in the panel means 26 and in the posts 22 which support particular panel means 26 when the panels are planar. Thermally induced expansions and contraction of the panel means 26 can lead to cracking of the panel means 26 unless somanar. Thermally induced expansions and contraction of the panel means 26 can lead to cracking of the panel means 26 unless some arrangement is established to relieve those thermally induced expansions and contractions. One arrangement of accommodating such thermally induced length variations is use of the joint packing material 72 described above in connection with FIG. 7. Another arrangement, and the most preferred embodiment of this invention, for accommodating these thermal expansions as well as for avoiding critical spacing problems is use of a folded panel means 74, as illustrated in FIG. 9.

The folded panel means 74 is supported in part by posts 22 which are the same in all material respects to those discussed above. The most preferred cross-sectional arrangement of the post is, however, illustrated in FIG. 11. The folded panel means 74 is similar to the panel means 26 discussed in connection with FIG. 1 in that it has shaped edges 28, 30 (FIG. 11) which conform to and are received by grooves provided in the sides of the wall posts 22. In addition to these features, however, each folded panel means 74 (FIG. 9) is provided with at least one hinged connection 76 positioned between the side edges 28, 30 and preferably positioned at approximately the center of the folded panel means 74. The hinged connection 76 is essentially parallel to the grooves in the posts 22 and the associated side edges 28, 30 of the folded panel means 74. In this manner, the hinged connection 76 permits the folded panel means 74 to flex in a direction perpendicular to the plane extending between adjacent posts 22.

This flexion capability provides significant advantages to the post and panel barrier illustrated. For example, thermally induced linear expansions and contractions of the wall panel 74 are accommodated by increased or decreased offset distances measured between the hinged connection 76 and the plane connecting adjacent posts 22. The offset provides a further benefit by increasing the front-to-back base thickness of the wall itself to resist toppling in response to wind pressures exerted on the face thereof. Another advantage of the folded panel means 74 resides in its ability to accomodate much greater tolerance in the spacing between adjacent posts. More particularly, the spacing between adjacent posts can be accommodated by increased or decreased offset in the folded panel means 74. The folded panel means 74 also allows the panel to be attached to posts without sliding panels down between posts 22. For example, the panel is folded while it is attached to one post and then unfolded sufficiently to attach with the next post. If desired, multiple hinged connections 76 may be provided in each panel means 74.

Figure 10:
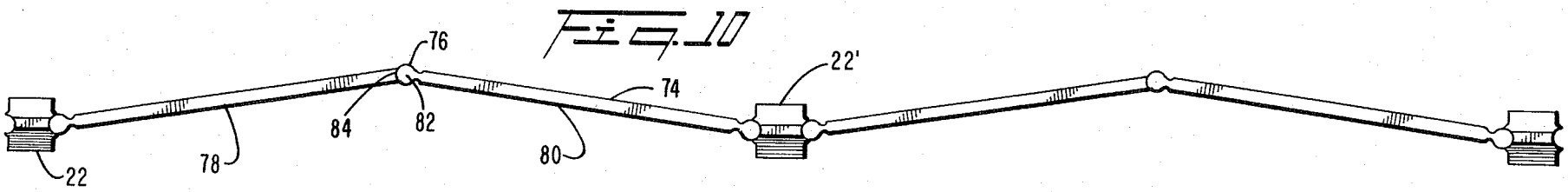
FIG. 10 is a plan view of a portion of the wall of FIG. 9.
Figure 14:
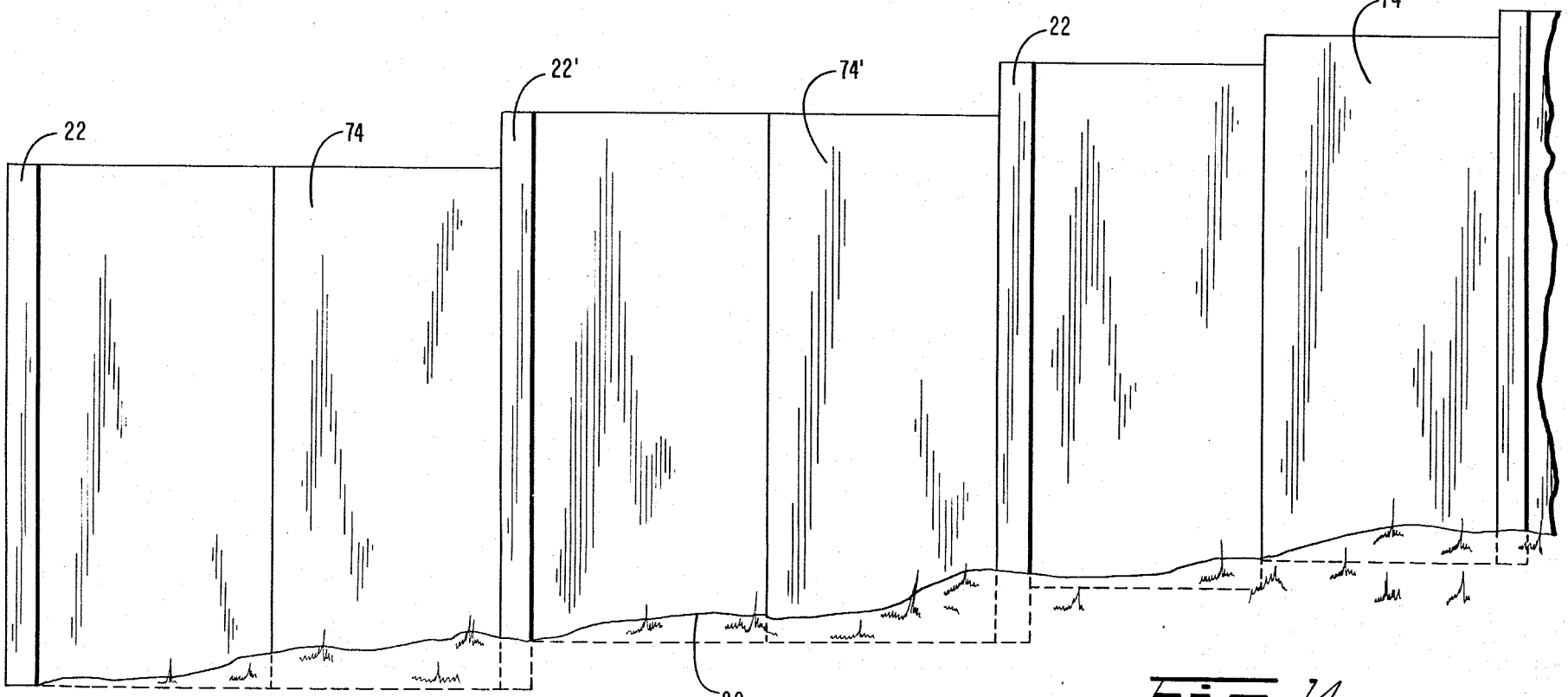
FIG. 14 is an elevational view showing the elevation adjustment possible with the present post and panel system.

The folded panel means 74 includes a first panel section 78 and a second panel section 80 (FIG. 10). The first panel section 78 is preferably provided with a bullnose adjacent the post 22. Similarly, the second panel portion 80 has a bullnose adjacent the groove of post 22'. The post 22' is adjacent to the opposite side edge of the folded panel means 74. The hinged connection 76 between adjacent panel sections 78, 80 preferably includes a bullnose 82 and conformingly shaped groove 84. The bullnose 82 may be provided on one of the two panel sections 78, 80 with the conformingly shaped groove 84 being provided on the other of the two panel sections 78, 80.

A flexible tensile connection means is provided between the panel portions 78, 80 at the hinge line 76 as described above in connection with the attachment of the panel assemblies 78 to the associated posts 22.

When the folded panel means 74 is used on a surface environment having substantial frost movement, each post 22 is supported by a foundation 90 (FIG. 12) which extends below the frost line. Accordingly the posts 22 are vertically fixed and do not move with frost heaves.

In some application it may be desirable to provide a foundation 92 under the hinged connection 76. Here again the foundation 92 would extend below the frost line. With this arrangement the folded panel assembly 74 is clearly grounded against vertical movements inducted by frost. It should however, be noted that even without a foundation 92 under the hinged connection 76 the folded panel assembly 74 is grounded.

More particularly, the panel 78 cannot rotate in its plane relative to the post 22 since the tensile connectors prevent such rotation. Moreover the attachment of the panel 78 to the panel 80 physically prevents such rotation and the tensile connectors are that hinged connection 76 further prevent the relative rotation. Thus, when the panel means 74 rests on the post foundations 90, there really is no need for the intermediate foundation 92.

In situations where the panel means 74 can be permitted to move vertically with frost induced surface movements (FIG. 13) the panel means 74 is provided with a cut-out 94 at the bottom corner on each side edge 28, 30. Each cut-out extends laterally from the corresponding side edge 28, 30 by a distance sufficient to clear the post foundation 90. In addition, each cut-out 94 extends vertically above the post foundation 90 by a distance sufficient to mechanically decouple the vertical panel movement from the post. The unconfined length of the tensile connectors will permit this vertical flexibility.

In order to seal the privacy barrier, a compressible sealing material 96 is positioned in the cut-out 94. Accordingly, the opening at the cut-out is prevented from providing a path for transmission of sight, sound, environmental radiation and the like.

When it becomes necessary to erect the wall in a region where the underlying ground contour 86 (FIG. 14) is not level, then adjacent folded wall panel means 74, 74' extending from opposite sides of a post 22' are vertically offset. This vertical offset is effected by using the predetermined spacing between the pairs of channels 62 (see FIG. 2). Accordingly, (see FIG. 14), the panel means 74' may be positioned at a higher elevation on the post 22' than the panel means 74. This arrangement creates a stepwise increase in elevation of the panel means 74 as the wall traverses an uneven or inclined ground surface. In some areas the ground contour may require more frequent elevation changes (e.g. where it is steep) or esthetics may require more gradual steps. In these situations, additional vertical offsets may be made at the hinged connection of folded panel means, as shown at 74''.

It will now be apparent to those skilled in the art that a new improved post and panel barrier structure has been described which overcomes the problems discussed above in connection with the prior art. Mod panel barrier structure has been described which overcomes the problems discussed above in connection with the prior art. Moreover, it will be apparent to those skilled in the art that numerous modifications, variations, substitutions and equivalents exist for various features of the invention as described in the foregoing specification. Accordingly, it is expressly intended that all such modifications, variations, substitutions and equivalents which fall within the spirit and scope of the appended claims, be embraced thereby.

What is claimed is:

1. A barrier structure comprising:

a pair of panel means for creating an environmental barrier, each panel means having a thickness and including a generally vertical edge provided with a substantially convex arcuate cross section;

a post positioned between the generally vertical edges of the panel means having a thickness greater than the thickness of the panel means and having a pair of sides, each side having a groove with a concave arcuate cross section, a nominal radius and generally conforming to the convex arcuate cross section, each groove having a depth, and a distance from the maximum depth to the plane of the corresponding post side, the groove depth, the distance, the thickness, and nominal radius being related to one another so that each panel means can be oriented parallel to the plane of the corresponding post side; and interconnection means engaging the panel means and the post, operable to secure the panel means and post together such that the pair of panel means may be essentially parallel.

2. A barrier structure comprising:

a pair of panel means for creating an environmental barrier, each panel means having a thickness and including a generally vertical edge provided with a substantially convex arcuate cross section;

a post positioned between the generally vertical edges of the panel means, having a pair of sides, each side having a groove with a concave arcuate cross section, a nominal radius and generally conforming to the convex arcuate cross section, each groove having a depth, and a distance from the maximum depth to the plane of the corresponding post side, the groove depth, the distance, the thickness, and nominal radius being related to one another so that each panel means can be oriented parallel to the plane of the corresponding post side;

interconnection means engaging the panel means and the post, operable to secure the panel means and post together such that the pair of panel means have an angle of essentially 0° therebetween; and wherein each panel means is relieved adjacent to the convex arcuate cross section to receive a portion of the post laterally adjacent to the groove and wherein the groove has a bottom in the plane of the corresponding post side.

3. A barrier structure comprising:

panel means having substantially exposed front and back surfaces, a pair of vertical shaped edges, and being exposed to pressure on each surface which generates a predetermined substantially non-uniform distributed load along each shaped edge;

two posts, each post being along the corresponding one of the shaped edges, having a first location with a first cross section, a second location with a second cross section, and the post cross section varying from the first location to the second location such that maximum bending stress in the post cross section imposed by the predetermined substantially non-uniform distributed load is substantially constant between the first location and the second location for bending normal to the plane between the two posts; and connecting means for connecting each post and the corresponding shaped edge.

4. The barrier structure of claim 3, wherein the posts are precast from concrete.

5. The barrier structure of claim 3, wherein the panel means is fabricated from concrete.

6. A barrier structure, comprising:

panel means having substantially exposed front and back surfaces, a pair of vertical shaped edges, and being exposed to pressure on each surface which generates a substantially nonuniform distributed load along its shaped edge;

two posts, each post being along the corresponding one of the shaped edges, having a first location with a first cross section, a second location with a second cross section, and the post cross section varying from the first location to the second location such that maximum bending stress in the post cross section is substantially constant between the first location and the second location for bending normal to the plane between the two posts;

connecting means for connecting each post and the corresponding shaped edge; and wherein the posts are spaced apart by a predetermined distance and the panel means includes a first and a second panel, the first and second panels being connected and having a combined width which exceeds the predetermined distance between the precast posts so that the panels stiffen the structure in the direction perpendicular to the distance between adjacent posts.

7. The barrier structure of claim 3, wherein the shaped edge of the panel means is partially received by a similarly shaped groove of the adjacent post.

8. The barrier structure of claim 7, wherein the shaped edge of the panel means is contoured and the groove is similarly contoured.

9. The barrier structure of claim 8, wherein the shaped edge of the panel means is arcuate and encompasses an angle of more than 180° and the groove is arcuate and encompasses an angle of about 90° so that the panel means can form corners in the barrier structure.

10. The barrier structure of claim 7 further including a resilient packing material positioned between the shaped edge in the groove to accommodate variances in casting tolerances.

11. The barrier structure of claim 3, wherein the post has an essentially uniform thickness between the first location and the second location and wherein the depth of the post varies between the first and second locations to provide the substantially constant bending stress.

12. The barrier structure of claim 11, wherein the post depth is oriented perpendicularly to the distance between the posts.

13. A post for use in a barrier structure comprising:

an elongated precast member having a top, a bottom, a front surface, a back surface, and a pair of generally parallel side surfaces, the front and back surfaces being spaced from one another by a distance increasing from the top to the bottom and selected such that a substantially constant bending stress exists in the front and back surfaces when the post supports a predetermined non-uniform distributed load, and each side surface having a groove extending essentially from top to bottom to accommodate a panel edge.

14. A post for use in a barrier structure comprising:

an elongated precast member having a top, a bottom, a front surface, a back surface, and a pair of generally parallel side surfaces, the front and back surfaces being spaced from one another by a distance increasing from the top to the bottom and selected such that a substantially constant bending stress exists in the front and back surfaces when the post supports a predetermined distributed load, and each side surface having a groove extending essentially from top to bottom to accommodate a panel edge; and further including a plurality of channels extending between the side surfaces and operable to receive connector means.

15. An environmental barrier comprising:

a plurality of posts, each post having a cross section which varies from one location to a second longitudinally spaced location such that maximum bending stress in the post cross section is essentially constant between the first and second locations normal to the plane between adjacent posts, having a pair of sides with a groove in each side;

a plurality of panel means, each panel means extending between a pair of adjacent posts, operable for exposure to a nonuniform vertical distributed wind pressure, and having a generally planar surface on which the distributed wind pressure may act;

a pair of convex edges, each edge engaging a corresponding groove of a post and being conformingly shaped thereto;

resilient packing means between the conformingly shaped edge and groove; and connection means for attaching a pair of panel means to each post such that the convex edges engage the corresponding grooves and compress the packing means therebetween.

16. The environmental barrier of claim 15 wherein a post has a slot at bottom of the groove and the packing means is substantially confined to the slot.

17. The environmental barrier of claim 15 wherein a panel means has an outline shape that is vertically spaced from interfering portions of the adjacent post to mechanically decouple vertical movement of that panel means from the corresponding posts.

18. The environmental barrier of claim 15 wherein at least one post and corresponding panel means are configured to permit the panel means to meet at an included angle of essentially 0°.

19. An environmental barrier comprising:

a plurality of posts, each post having a cross section which varies from one location to a second longitudinally spaced location such that maximum bending stress in the post cross section is essentially constant between the first and second locations normal to the plane between adjacent posts, having a pair of sides with a groove in each side;

a plurality of panel means, each panel means extending between a pair of adjacent posts, operable for exposure to a nonuniform vertically distributed wind pressure, and having a generally planar surface on which the distributed wind pressurnuniform vertically distributed wind pressure, and having a generally planar surface on which the distributed wind pressure may act;

a pair of convex edges, each edge engaging a corresponding groove of a post and being conformingly shaped thereto;

resilient packing means between the conformingly shaped edge and groove;

connection means for attaching a pair of panel means to each post such that the convex edges engage the corresponding grooves and compress the packing means therebetween; and wherein at least one panel means includes a pair of panel members connected at a substantially vertical joint.

* * * * *